United States Patent [19]

Goode

[11] 4,367,610

[45] Jan. 11, 1983

[54] DOOR OPENING AND CLOSING MECHANISM

[75] Inventor: David J. Goode, Great Missenden, England

[73] Assignee: John Mowlem & Company Limited, Brentford, England

[21] Appl. No.: 137,192

[22] Filed: Apr. 4, 1980

[30] Foreign Application Priority Data

Apr. 10, 1979 [GB] United Kingdom ..... 7912499

[51] Int. Cl.[3] ..... E05F 11/00

[52] U.S. Cl. ..... 49/336; 49/340

[58] Field of Search ..... 49/336, 381, 280, 340, 49/334, 339; 292/359; 160/188

[56] References Cited

U.S. PATENT DOCUMENTS

| | | | |
|---|---|---|---|
| 572,299 | 12/1896 | Hicks | 49/339 X |
| 1,569,634 | 1/1926 | Sibley | 49/339 X |
| 1,835,103 | 12/1931 | Vanderveer | 49/280 |
| 1,920,868 | 8/1933 | Kirk | 49/280 X |
| 2,733,918 | 2/1956 | Fischer | 49/280 |
| 2,929,651 | 3/1960 | Friedman et al. | 292/359 X |
| 3,470,653 | 10/1969 | Kalog | 49/334 |
| 3,699,717 | 10/1972 | Hedrick | 49/336 X |

*Primary Examiner*—Philip C. Kannan

*Attorney, Agent, or Firm*—Sughrue, Mion, Zinn, Macpeak and Seas

[57] ABSTRACT

An opening and closing mechanism for a blast resistant pivoted door includes a torque tube assembly connected between a rotary actuator and the door, the torque tube assembly being arranged to absorb the rebound of the door after a blast to help prevent damage both to the actuator and the door by the rebound. Preferably the torque tube assembly is formed by a central shaft arranged inside a tube, one of the ends of the central shaft and tube being fixed together with the other end of the shaft being connected to the rotary actuator and the other end of the tube being connected to the door.

6 Claims, 3 Drawing Figures

DOOR OPENING AND CLOSING MECHANISM

This invention is concerned with a door opening and closing mechanism which is particularly intended to be used with a blast resistant door or pivoted door.

Blast resistant buildings are provided to house personnel and important and expensive equipment, for example control equipment, in potentially dangerous environments. Examples of such potentially dangerous environments are oil refineries and chemical works where, in the event of an explosion, it is important that the main control room remains as secure and undamaged as possible together with its control equipment so that control can be exercised on the plant during the subsequent emergency. Such blast resistant enclosures naturally include access apertures for personnel and equipment and these are typically closed by heavy blast resistant doors which usually weight between 350 kg and 750 kg and typically 500 kg each. Such doors are ideally pivotally hung so that they open outwards away from the protected area and the frame in which the door is hung includes a stop which is made integrally with or, fixed strongly to it. In the closed position, the door rests against the stop and, in the event of a blast occurring outside the protected area the door is urged inwards by the blast against the stop.

Such arrangements are very strong and secure in the event of a blast but, the strain energy built-up in the door by the blast and the vacuum following immediately behind the shock wave causes the door to rebound and pivot open, immediately after the blast. Since on the rebound, the door is not supported about its periphery by the stop but, instead is only held by some form of latch or locking arrangement the rebound invariably destroys the locking arrangement with the result that the door is flung open.

Naturally, it is important that blast resistant doors are normally maintained in the closed position and, in view of their weight, it is very difficult to open and close such doors manually. For this reason, it is common for such doors to include some form of opening and closing mechanism to ensure that they are normally maintained in the closed position but enable them to be opened upon demand without any great manual effort. When such doors are flung open on the rebound after a blast this usually destroys the opening and closing mechanism and this leads to the door remaining open and being impossible to close so that the personnel inside the protected area are exposed to risk from fire, fumes and any subsequent blast.

According to this invention, an opening and closing mechanism for a blast resistant pivoted door includes a torque tube assembly connected between a rotary actuator and the door, the torque tube assembly being arranged to absorb the rebound of the door after a blast to help prevent damage both to the actuator and the door by the rebound.

Preferably the torque tube assembly is formed by a central shaft arranged inside a tube, one of the ends of the central shaft and tube being fixed together with the other end of the shaft being connected to the rotary actuator and the other end of the tube being connected to the door. Preferably, a shear pin is included between the tube and shaft at the other end so that, in use, rotary movement is transferred directly from the one end of the shaft to the one end of the tube via the shear pin but, in the event of rebound of the door after a blast, the shear pin fails, to allow the other end of the shaft and tube to rotate with respect to one another and build up a torsional strain in the torque tube assembly and thereby provide a restraint and a controlled movement of the door.

Preferably the central shaft includes a locking mechanism to lock it against rotation and thereby prevent opening of the door. Providing a locking mechanism which engages this central shaft ensures that there are no latches or locking bolts which can be damaged and jammed when the door rebounds if it is subjected to a blast. The provision of a lock on the central shaft also helps to ensure that the rebound is absorbed by the torque tube assembly and prevents too great a load being transferred to the rotary actuator.

Preferably the rotary actuator is pneumatically operated and comprises two single acting pneumatic piston and cylinder assemblies arranged at opposite ends of a rack, the rack meshing with a pinion which is connected to the top of the central shaft of the torque tube assembly. Particularly when the actuator is pneumatically operated it is preferred that the locking mechanism for locking the central shaft against rotation is held in the locked position by a pneumatic ram. Preferably the locking mechanism is spring-biased in the unlocked position so that, in the event of a failure of the pneumatic supply, the locking mechanism is released. Preferably the rotary actuator and the locking mechanism are all housed in a housing above, or positioned beneath, the door.

The opening and closing mechanism may be arranged as an independent unit which can be connected to an existing blast resistant door and, in this case, it preferably includes an arm having one end fixed to the other end of the tube of the torque tube assembly and a telescoping arrangement on the other end of the arm which is, in use, fixed to the door and which enables the length of the arm to vary as the door is opened and closed. Alternatively, the door opening and closing mechanism may be incorporated as an integral part of a blast resistant door and, in this case, the torque tube assembly or, the central shaft of the assembly, may form the pin about which the door is hinged. In this case, the torque tube assembly, or the central pin of the torque tube assembly, is housed in bearings at the top and bottom of the frame and, further bearings are included between the tube and the central shaft of the torque tube assembly to enable the torque tube assembly to resist the axial bending moment caused by the weight of the door.

A particular example of a door opening and closing mechanism will now be described with reference to the accompanying drawings; in which.

Figure 1:
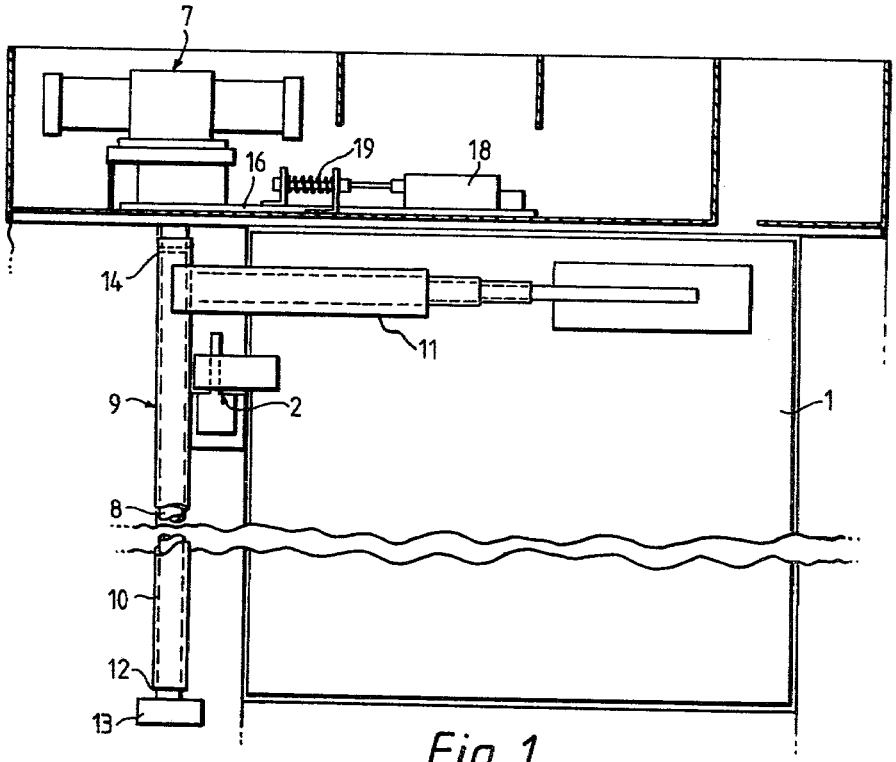
FIG. 1 is a front elevation of the door and mechanism.
Figure 2:
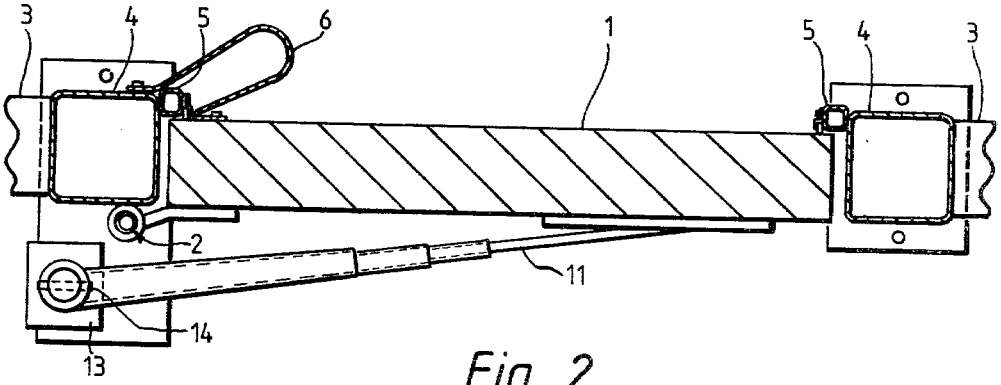
FIG. 2 is a sectional elevation to an enlarged scale taken along the lines II—II shown in FIG. 1; and, FIG. 3 is a partly cut away plan of the pneumatic actuator and door locking mechanism.

A blast resistant door 1 fabricated from steel channel and covered by steel plate is hung from three gudgeon and pintle-type hinges 2, only one of which is shown in FIG. 1, inside a frame securely bonded into a wall 3 of a blast resistant building. The frame is formed from square-section rolled steel channel 4 with a smaller section rolled steel channel 5 welded to it to provide a stop. The door is arranged to pivot outwards and to close against the stop. A strip of flexible material 6 is provided to cover the opening edge of the door and prevent anything getting jammed between the opening edge of the door 1 and the frame.

A door opening and closing mechanism includes a pneumatic rotary actuator 7 connected to a shaft 8 forming part of a torque tube assembly 9, an outer tube 10 of which is connected to an arm 11 embodying a telescoping arrangement at one end. The lower end 12 of the shaft 8 and the tube 10 are welded together and the lower end of the shaft 8 is housed in a bearing 13 mounted in the floor of the building. The upper end of the tube 10 and the shaft 8 are connected together by a copper shear pin 14. The shaft 8 between the upper end of the tube 10 and the pneumatic actuator has parallel opposed flats 15 and this portion of the shaft 8 passes through a keyhole-shaped aperture 16 in a locking plate 17. A locking mechanism formed by a pneumatic ram 18 and return spring 19 is connected to the locking plate 17 and arranged so that with the locking ram 18 actuated, the locking plate 17 is moved across so that the parallel flats 15 of the shaft 8 are trapped between the parallel side portions of the keyhole-shaped aperture 16. Thus, the locking plate 17 prevents the shaft 8 from rotation. However, when the locking ram 18 is not actuated, the return spring 19 urges the locking plate to return so that the parallel flats 15 of the shaft 8 lay in the circular part of the keyhole-shaped aperture 16 and then the shaft 8 is free to turn.

Figure 3:
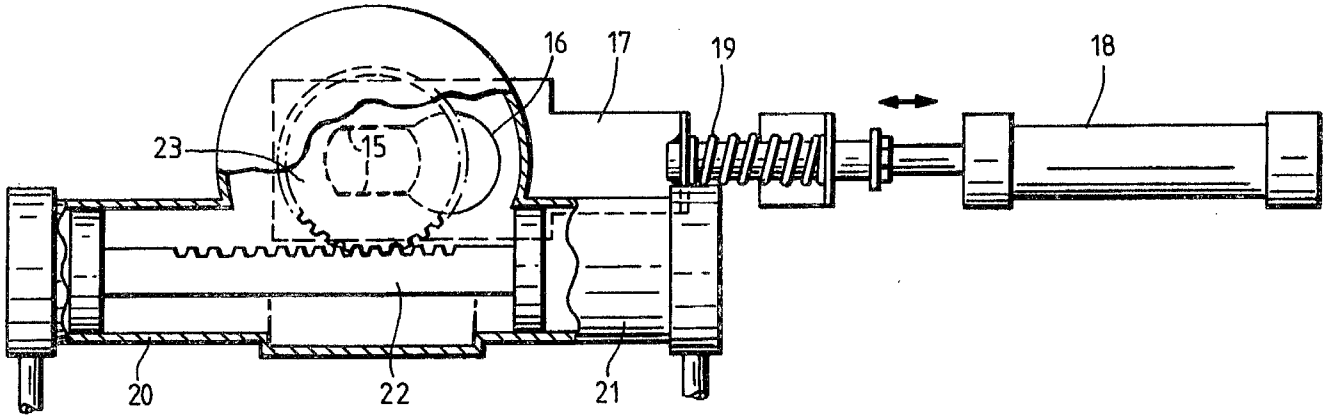

The pneumatic rotary actuator 7 is shown in more detail in FIG. 3 and this comprises a pair of opposed single acting pneumatic piston and cylinder assemblies 20 and 21 arranged at opposite ends of a rack 22. A pinion 23 which meshes with the rack is connected to the top of the shaft 8 so that translational movement of the rack 22 causes a rotary movement of the shaft 8 to occur. The actuator 7 is arranged to provide 100° of rotational movement.

The actuator may be arranged to open and close the door in response to a manual control or, alternatively, automatic sensors may be provided, for example pressure mats, photocells, or radar detectors, to open the door automatically on the approach of a person or vehicle. Preferably, a manual fail-safe device is provided to enable the piston and cylinder assemblies 20 and 21 to be vented to the atmosphere in the event of a failure of the pneumatic supply so that the door 1 may be opened manually.

In the event of a blast occurring in the vicinity of the building including the door 1 the door is first urged further inwards against the stop formed by the rolled steel channel 5. Upon rebound of the door 1, due to the strain energy built up in the door 1 during the blast, the door swings outwards. This movement causes the shear pin 14 to shear to allow both the outer tube 10 and the shaft 8 to twist with a resulting torsional strain occurring in both members which provides restraint on the rebound movement of the door and re-closes the door. The locking plate 17 engaging the parallel flats 15 of the shaft 8 locks the top of the shaft 8 in position and prevents any rotational movement being transmitted to the pneumatic rotary actuator 7. Thus, the torque tube assembly 9 absorbs the pivoting movement of the door on the rebound and prevents damage to the door and its mounting and also prevents damage to the pneumatic rotary actuator 7.

I claim:

1. An opening and closing mechanism for a blast resistant pivoted door, said mechanism including a rotary actuator; an elongated torque tube assembly having two operative ends, first means connecting one end of said torque tube assembly with said rotary actuator; second means connecting the other end of said torque tube assembly to a blast resistant door, rotary movement generated by said rotary actuator being transmitted through said torque tube assembly via said first and second connecting means to open and close said door, and means enabling said torque tube assembly to be strained torsionally by rotating one end thereof with respect to said other end in response to a blast rebound, whereby said torque tube assembly absorbs said rebound and helps prevent damage both to said actuator and to said door.

2. The opening and closing mechanism of claim 8, wherein said torque tube assembly comprises a tube, and a shaft arranged inside said tube, one end of said shaft forming said one end of said torque tube assembly and being connected to said rotary actuator, the other end of said shaft being fixed to one end of said tube, and the other end of said tube forming the other end of said torque tube assembly and being coupled to said second connecting means.

3. The opening and closing mechanism of claim 2, wherein said torque tube assembly also includes a shear pin passing through said one end of said shaft and said other end of said tube to connect them together, whereby, in normal use, said shear pin transmits rotary movement generated by said rotary actuator directly from said one end of said shaft to said other end of said tube, whereas, during rebound of said door after a blast, said shear pin shears to allow said one end of said shaft and said other end of said tube to rotate with respect to one another, to build up said torsional strain in said torque tube assembly.

4. The opening and closing mechanism of claim 2, wherein said enabling means includes a locking mechanism, said locking mechanism engaging with said one end of said shaft to lock it against rotation.

5. The opening and closing mechanism of claim 2, wherein said rotary actuator is pneumatically operated and comprises two single acting pneumatic piston and cylinder assemblies, a rack and a pinion, opposite ends of said rack being connected to said pneumatic piston and cylinder assemblies, said rack meshing with said pinion, and said pinion being connected to said one end of said shaft of said torque tube assembly.

6. The door opening and closing mechanism of claim 5, wherein said second connecting means includes an arm and a telescoping means, one end of said arm being fixed to said other end of said tube and the other end of said arm being connected to said telescoping means which is fixed to said door and which enables the distance between said torque tube assembly and said door to vary as said door is opened and closed.

* * * * *